United States Patent [19]

Ferrari

[11] Patent Number: 4,791,740

[45] Date of Patent: Dec. 20, 1988

[54] DECORATIVE DISPLAY ARCH

[76] Inventor: John B. Ferrari, 114 South Osborne Ave., Margate, N.J. 08402

[21] Appl. No.: 896,497

[22] Filed: Aug. 13, 1986

[51] Int. Cl.[4] ..... G09F 1/10

[52] U.S. Cl. ..... 40/124; 40/538; 40/584; 40/594; 40/606; 40/610; 52/211

[58] Field of Search ..... 40/124, 124.1, 124.2, 40/124.4, 1 R, 594, 538, 539, 606, 611, 10 R, 618, 466, 605, 610; 52/211, 86, 301, 311, 312, 632, 105, 217; D25/77; 49/504; 211/45, 44; 160/135; 446/110–113, 85, 109

[56] References Cited

U.S. PATENT DOCUMENTS

| | | | |
|---|---|---|---|
| 346,187 | 7/1886 | Boda | 52/211 |
| 496,152 | 4/1893 | Duckett | 40/124 |
| 1,520,472 | 12/1924 | Hurst | 40/605 |
| 1,541,004 | 6/1925 | Taylor | 446/113 |
| 1,602,774 | 10/1926 | Mullowney | 40/584 |
| 2,035,651 | 3/1936 | Hailparn | 40/539 |
| 2,278,695 | 4/1942 | Fluss | 40/124 |
| 2,579,943 | 12/1951 | Marchand | 52/211 |
| 2,635,375 | 4/1953 | Hays | 40/610 |
| 3,236,481 | 2/1966 | Howard | 40/606 |
| 3,260,022 | 7/1966 | Guyer et al. | 52/86 |
| 3,327,419 | 6/1967 | Stanos | 40/124 |
| 3,581,419 | 6/1971 | McCrackon | 40/124 |
| 3,591116 | 7/1971 | Dalom | 40/610 |
| 3,778,945 | 12/1973 | Medow | 52/217 |

FOREIGN PATENT DOCUMENTS

| | | | |
|---|---|---|---|
| 588328 | 12/1959 | Canada | 40/606 |
| 731259 | 8/1932 | France | 40/606 |
| 739175 | 1/1933 | France | 40/606 |
| 1037383 | 9/1953 | France | 40/610 |

OTHER PUBLICATIONS

Anderson's 1980 Prom Catalog, page 62.

*Primary Examiner*—Gene Mancene
*Assistant Examiner*—J. Hakemake
*Attorney, Agent, or Firm*—Seidel, Gonda, Lavorgna & Monaco

[57] ABSTRACT

A device for displaying decorative articles such as photographs, greeting cards, or the like having five sections which are pivotably attached to one another for rotation about the pivot in adjacent parallel planes so that the sections may be shaped to conform to various patterns such as the arch of a doorway or the outline of a window frame and folded into a single longitudinal section for easy storage and packaging. The display is adaptable to various size doorways by providing a slideable attachment with respect to the relative edge of at least two adjoining sections. The display may be utilized for supporting and displaying decorative articles in a convenient and attractive arrangement.

5 Claims, 2 Drawing Sheets

FIG. 1
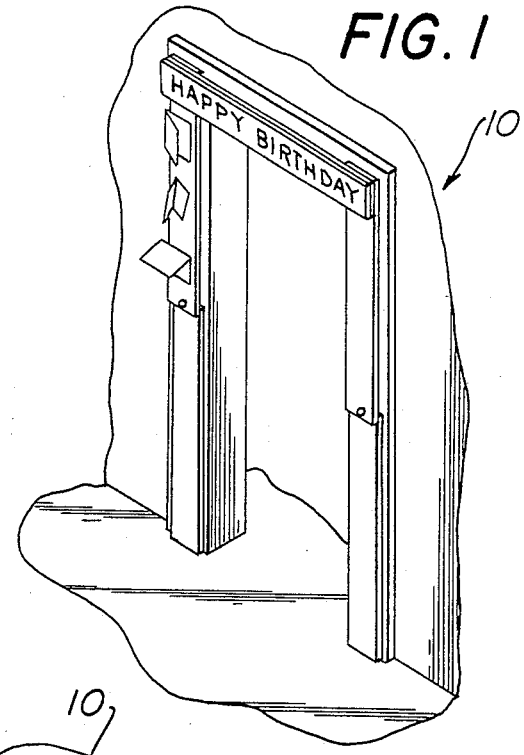
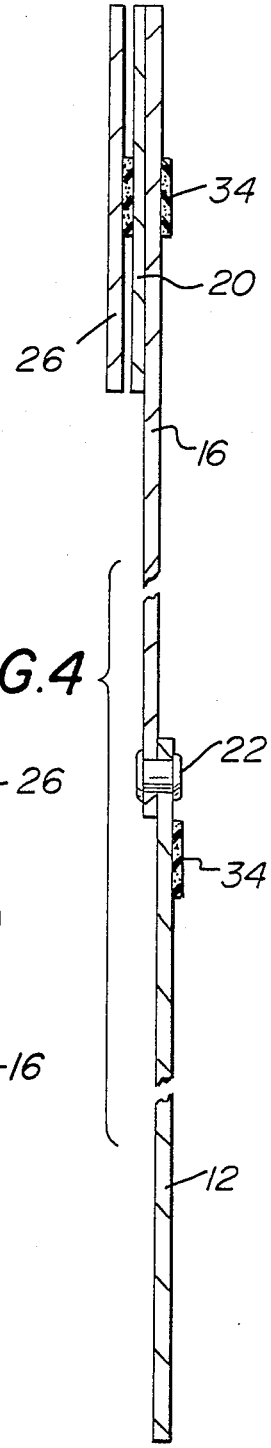
FIG.4
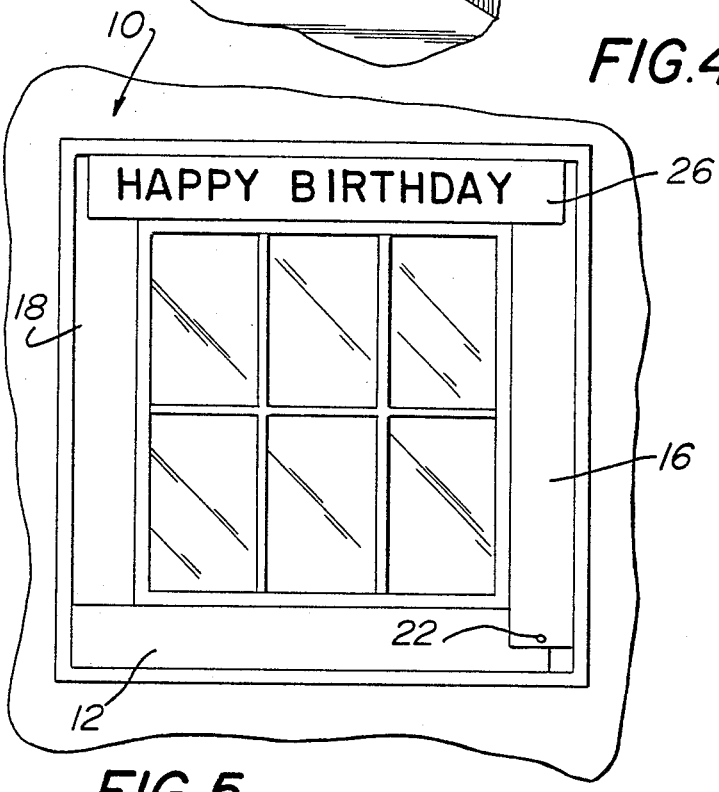
FIG.5

DECORATIVE DISPLAY ARCH

BRIEF SUMMARY OF THE INVENTION

The present invention relates to a device for use in houses, offices, schools, trade shows and the like to display greeting cards or individual display articles and arrange these articles in a decorative and orderly manner. The invention further relates to a device which may be positioned around a typical door or window frame so as to provide an outline of the frame. The invention further relates to a display which may be collapsed or folded into a convenient size for packaging and sale or storage.

BACKGROUND OF THE INVENTION

Decorative objects such a greetings cards, photographs and the like are typically mounted on a wall or support surface in an individual and undefined manner. Known card hanging devices, such as that disclosed in Fluss Pat. No. 2,278,695 and McCracken Pat. No. 3,581,419, include devices which hang from a single point to define a structure for placement of greeting cards and the like.

The Fluss patent shows a card holder having a strip which hangs vertically from a suction cup support. Sheets or other materials are variably positioned on the strip as it hangs. The sheets are retained on the strip by mounts having two horizontal slots through which the strip is inserted. The mounts engage the strip by a clamping action of the portion of the mounts adjacent the slots and support the sheet adjacent the strips.

McCracken shows a decorative tree shaped structure to be positioned within a doorway and for holding greeting cards. The tree includes a vertical hanging ribbon upon which tree shaped sections are hung. The cards are secured on the tree by insertion into slots and by folding the cards over at their inserted end to utilize the frictional engagement of the slot with the card.

SUMMARY OF THE INVENTION

The apparatus of the invention includes a display which may conform to the shape, size and structure of a typical doorway or window or the like. The display includes a multiplicity of pivotably attached sections which are provided in, preferably, uniform dimensions so as to be easily and decoratively hung around and adjusted to the size of the frame of a door or window as desired. The sections are provided with a pivot at their adjoining ends and are rotatable in adjacent planes about the pivot for hanging and for reshaping. The pivoting engagement of two sections may also be provided within slots or grooves so that the location of the pivots may be rearranged to adjust the relative position of the sections with respect to one another to permit adjustment to fit various size doorways or windows in a decorative and uniform pattern. the device may also be firmly positioned in any desired shape by mounting onto a wall or other support surface. The sections are preferably made of a sturdy cardboard material and are supported by means of a dual sided adhesive such as a double faced foam pressure adhesive similar to that commercially marketed by the 3M Company under the brand name "SCOTCH" (Registered Trademark). Greeting cards, snapshots, bulletins, signs or the like may be displayed in an organized and attractive manner on the surface of the display and around structures such as doors, windows or the like.

Further objects and advantages of the invention will become apparent by particularly describing a preferred embodiment thereof. For the purpose of illustrating the invention, there is shown in the drawings a form which is presently preferred; it being understood, however, that this invention is not limited to the precise arrangement and instrumentalities shown.

BRIEF DESCRIPTION OF THE DRAWINGS

FIG. 1 shows a perspective view of the invention as formed in an arch around a doorway.

FIG. 4 is a side cross-sectional view as taken along line 4—4 in FIG. 2.

FIG. 5 is an alternate view of the invention shown in FIG. 1 as formed around a window frame.

DETAILED DESCRIPTION OF THE INVENTION

Figure 2:
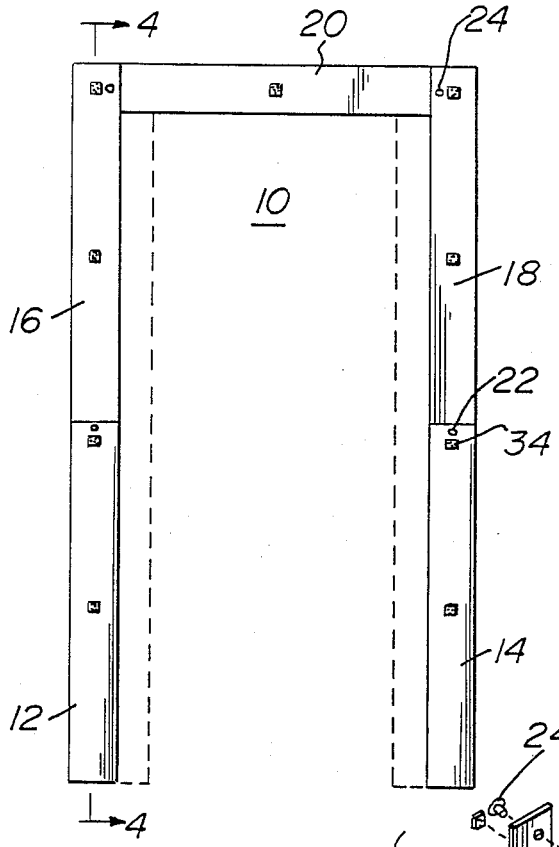
FIG. 2 is a rear plan view of the invention as arranged and shown in FIG. 1.

In the drawings where like numerals indicated like elements there is shown a decorative display which is generally referred by the numeral 10. As shown in FIG. 1 the display 10 generally includes a number of defined and separate sections which may be arranged in a number of convenient positions. The display 10 may be arranged, as shown in FIG. 1, to conform generally to the shape of an arch and be positioned around a doorway or, as shown in FIG. 5, be positioned around the frame of a window. Greeting cards or the like may then be placed onto the surface of the display 10 in an orderly and decorative manner.

The display 10 preferably includes five sections, although more or less are contemplated, including: two lower leg sections 12 and 14, two upper leg sections 16 and 18, and a central face section 20. A face card 26 may optionally be attached to the outside of face section 20 to provide further decoration on the display 10. Each lower leg section 12, 14 is connected at one end to an upper leg section 16, 18, respectively. The joint between the lower leg sections 12 and 14 and their corresponding upper leg sections 16 and 18 is generally made by pivoting means 22 such as an eyelet, rivet or screw posts, as desired. The pivot 22 between the lower leg section 12 and its corresponding upper leg section 16 is preferably made at a point such that the two sections 12 and 16 are rotatable about that point within adjacent planes. Face section 20 is pivotably attached at its opposite ends to a corresponding upper leg section 16 and 18, respectively, at the end opposite of the connection to the lower leg sections 12 and 14. Connection of the face section 20 to the upper leg sections 16 and 18 is, preferably, made by a connection means 24 similar to attachment means 22 provided between the upper leg sections 16, 18 and the lower leg sections 12, 14.

Figure 3:
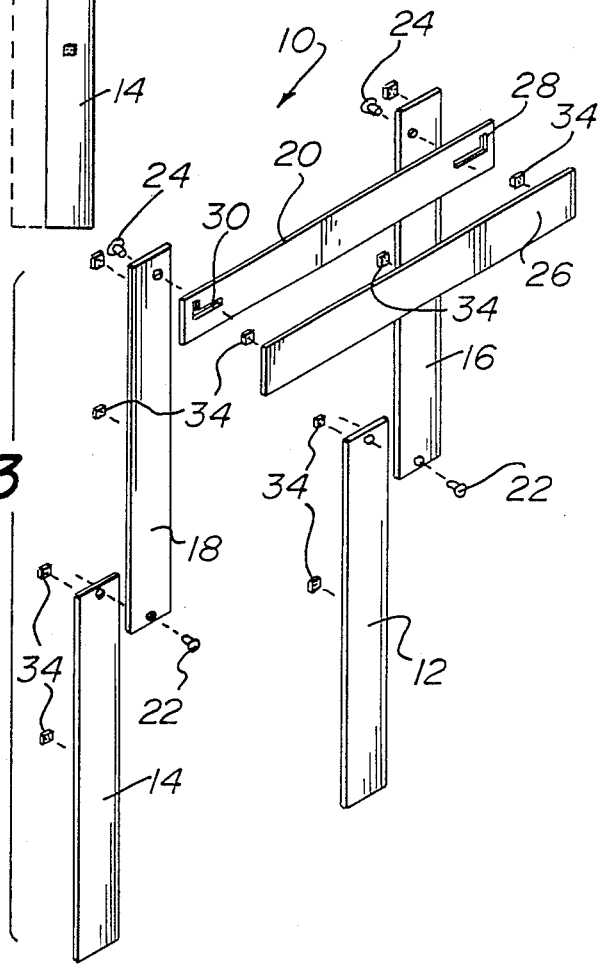
FIG. 3 is an exploded perspective view of the invention as illustrated in FIG. 1.

As can be seen in FIG. 3 the five sections of the display, preferably, have the same dimensions. The preferred dimensions of the these sections 12–20 are 38 inches in length and 5 inches in width. The sections 12–20 are also, preferably, made from paper or cardboard of the gauge typically known as "show cardboard". Connection means 22 is preferably positioned approximately one half inch from the end of sections 12–18 and located at the center of the width. The form and dimensions herein preferred have been selected to conform to the typical dimensions of a doorway and/or window. It should be noted however, that any size or shape may be utilized as desired with the cardboard being decorated with illustrations or colors. By providing substantially equivalent section lengths the display 10 may be folded in a convenient manner so as to create ease of packaging and storage.

Face section 20 is preferably provided at opposite ends with a slot 28 and 30. The slots 28, 30 form an "L" shape and are positioned adjacent the longitudinal ends of the section with one portion of the "L" shape preferably positioned parallel to the end edge of section 20 and the other portion of the "L" shaped slot 28, 30 extending along central longitudinal axis of the face for a defined distance. The dimensions of slots 28, 30 are preferably 1¾ inches by 4 inches with the relatively longer portion being positioned along the center line of face section 20. The slots 28, 30 are also positioned preferably 1 inch from the edges of the face section 20. Slots 28, 30 on face section 20 provide a groove for connection means 24 to be adjusted along the length and width of the face section 20 so as to reposition the relative spacing between the opposing upper leg sections 16, 18 along with their corresponding lower leg sections 12, 14 for adjustment and adaptation to various size doors, windows and the like. Additionally, by providing a portion of the slot 28 and 30 extending parallel to both side edges of the face 20 the connection means 24 may be repositioned both vertically as well as horizontally.

Connection means 24 is, preferably, fixedly attached to the upper leg sections 16, 18 offset from the center of its length at a position 1 inch from the lateral edge of upper leg sections 16, 18 and 2½ inches from its edge. By offsetting the attachment in this manner, the side legs 12, 16 and 14, 18 may be further extended from the ends of face section 20 to define a wide breadth. Additionally, when folding the legs 12, 16 and 14, 18 for packaging or storage, the face 20 may be placed in a position substantially conforming to the dimensions of the leg sections 12–18. Also, as shown in FIG. 2, the side legs 12–18 may be adjusted to their relative maximum or minimum positions so as to square the edges at the top end of the arch form or other display shape. Connecting means 22 is provided in the center of the leg sections 12–18 so as to provide a linear leg extension from the face section 20.

The face card 26 may be attached to the face section 20 in any convenient manner, such as by tape or dual sided adhesive squares similar to those marketed by the 3M Company under the brand name "SCOTCH" (Registered Trademark). This type adhesive includes a self-sticking unit which may be attached to various flat surfaces and is easily removed from such surfaces. This type adhesive may also be used for mounting the display 10 to the wall or other support surface. Adhesive squares 34 may be positioned at various locations on the rear surface of the display 10 so as to be attached to a wall or other flush mounting surface. The adhesive on the display 10 must be sufficient to support the weight of the display 10 so as to maintain it in a fixed location for an extended period of time. It is contemplated that approximately 8 to 10 squares of the double sided mounting adhesive are required for mounting the display 10, and also to attach the face card 26 to face section 20. Approximately 24 inches of mounting tape may be sufficient to support the cards and the like on the display 10.

As more particularly shown in FIG. 4 upper leg section 16 and the lower leg section 12 are attached by connecting means 22 with their surfaces being relatively parallel and aligned in adjacent planes. Lower leg section 12 may be folded upwardly to be positioned relatively even with the upper leg section 16 or folded sideways, as shown in FIG. 5, to wrap around a window frame. The relatively opposite lower leg section 14 may also be folded sideways behind leg section 12 so as to further enhance the frame around the window. All sides may also be folded into one uniform overlapping arrangement so as to provide for easy packaging since all sides of the display 10 will be parallel and adjacent in a singular framework.

the display 10 may be mounted on any flush mounting surface or rigid structures so as to generally define a frame or the like for positioning of photographs or other decorative display objects in a uniform and/or prearranged manner. Additionally, the display 10 may be removed and stored so as to be reuseable according to seasonal arrangements or the like. The display 10 may be folded for storage and replaced in any convenient manner or at any desired time.

Optional face card 26 may be a single uniform sheet such as a banner or the like and is preferably formed of a relatively thinner material than that of the leg sections 12–18 or the face section 20. As shown in the drawings, face card 26 may comprise a banner indicating the general theme of the decorations or displays such as "Happy Birthday", "Merry Christmas", "Happy Chanukah" or the like. Attachment of the face card 26 may be made in any convenient manner and typically will require less adhesive than the mounting of the display arch to a wall or flush mount surface.

The present invention may be embodied in other specific forms without departing from the spirit or essential attributes thereof and, accordingly, reference should be made to the appended claims, rather than to the foregoing specification, as indicating the scope of the invention.

I claim:

1. A display device for framing a door, window and the like, for mounting on a wall or support surface and for supporting articles and the like in a decorative manner, the display comprising: a face section, two leg sections pivotably attached at opposite ends of the face section, the leg sections pivotable in adjacent parallel planes with respect to one another and with respect to the face section, means for adjusting the position of attachment of each leg section with respect to the ends of the face section comprising a slot formed in the face section and attachment means on the leg section engaged in and movable along the length of the slot, the means for adjusting permitting the attachment means to slide relative to the ends of the face section to adjust the width between the two leg sections whereby the leg and face sections are adaptable to the dimensions of a door, window and the like as desired, and means for mounting the leg sections and the face section flush to a support surface adjacent the door, window and the like.

2. A display device as claimed in claim 1 wherein the slots are "L" shaped with one portion of the "L" shape being positioned parallel and adjacent the ends of the face section.

3. A display device as claimed in claim 1 wherein the other portion of the "L" shaped slots is positioned along the longitudinal center line of the face section substantially perpendicular to the first mentioned portion of the "L" shaped slot.

4. A display device as claimed in claim 1 further comprising a face card adapted to be mounted over the face section.

5. A display for framing a door, window or the like adapted to adjust to the standard dimensions of the door or window, the display comprising: two leg sections each having an upper portion and a lower portion, the upper portion and lower portion arranged linearly with respect to one another, pivot means attaching the upper portion to the lower portion such that the portions are rotatable in adjacent parallel planes about the pivot, a face section attached at its opposite ends to one portion of each of the leg sections, means attaching the face section to each leg section at a pivot such that the leg sections are rotatable in adjacent parallel planes with respect to one another, the attachment means further adapted for adjustment of the relative position of the pivot with respect to the ends of the face section and comprising a slot formed in the face section in which the attachment is engaged and movable so that the width between the opposite leg sections is continuously adjustable so as to conform to the standard dimensions of a door, window and the like, means provided for attaching the display to a support surface adjacent to the door, window and the like, and means for maintaining articles on the exposed surfaces of the leg and face sections so as to arrange the articles in a decorative manner.

* * * * *